US007285745B2

(12) United States Patent
Simoen

(10) Patent No.: US 7,285,745 B2
(45) Date of Patent: Oct. 23, 2007

(54) METHOD FOR MANUFACTURING COMPONENTS CONSISTING OF ONE PIECE WHICH APPEAR IN A WEAVING MACHINE

(75) Inventor: Daniel Simoen, Waregem (BE)

(73) Assignee: N.V. Michel Van de Wiele, Kortrijk/Marke (BE)

( * ) Notice: Subject to any disclaimer, the term of this patent is extended or adjusted under 35 U.S.C. 154(b) by 350 days.

(21) Appl. No.: 10/678,647

(22) Filed: Oct. 6, 2003

(65) Prior Publication Data

US 2005/0274700 A1 Dec. 15, 2005

(30) Foreign Application Priority Data

Oct. 4, 2002 (BE) ..... 2002/0575

(51) Int. Cl.
*D03C 9/04* (2006.01)
*B23K 26/20* (2006.01)
*B23K 11/16* (2006.01)

(52) U.S. Cl. ..... 219/121.64; 139/93; 219/118

(58) Field of Classification Search ..... 219/121.64, 219/117.1, 118; 139/91, 92, 96, 93, 94, 95; 451/113; 66/123; 140/72; 29/4.6, 7
See application file for complete search history.

(56) References Cited

U.S. PATENT DOCUMENTS 997,283 A * 7/1911 Fehr et al. ..... 139/96
2,019,822 A 11/1935 Kaufmann
3,464,163 A * 9/1969 Ferrara ..... 451/113
3,628,574 A * 12/1971 Ramseier ..... 140/72
4,404,995 A * 9/1983 Bowen et al. ..... 139/92
4,476,900 A * 10/1984 Bowen ..... 139/91
4,508,145 A * 4/1985 Bowen et al. ..... 139/92
4,817,399 A * 4/1989 Sos et al. ..... 66/123
4,901,767 A * 2/1990 Koch ..... 139/92
5,297,589 A * 3/1994 Baumann ..... 139/91
5,809,647 A * 9/1998 Wagner et al. ..... 29/890.048
5,828,032 A * 10/1998 Krzys et al. ..... 219/121.64
6,176,270 B1 * 1/2001 Mettler ..... 139/93
6,230,756 B1 * 5/2001 Baumann et al. ..... 139/93
2005/0061384 A1 * 3/2005 Holly ..... 139/91

FOREIGN PATENT DOCUMENTS

BE 571667 3/1962
DE 432018 7/1926
JP 60/119245 6/1985
JP 60-119245 A * 6/1985
JP 5-195370 A * 8/1993

* cited by examiner

*Primary Examiner*—Geoffrey S. Evans
(74) *Attorney, Agent, or Firm*—James Creighton Wray; Clifford D. Hyra

(57) ABSTRACT

The invention relates to a method for manufacturing components consisting of one piece which appear in a weaving machine, comprising one or more first and second parts, said parts being manufactured in separate first and second parts and joined together to form a whole by means of processes which practically do not change the cross-section of said parts, said first and second parts have:

different mechanical and/or magnetic and/or tribological properties; and/or a different manufacturing method; and/or different shape properties according to their functional requirements in the component.

4 Claims, 2 Drawing Sheets

METHOD FOR MANUFACTURING COMPONENTS CONSISTING OF ONE PIECE WHICH APPEAR IN A WEAVING MACHINE

This application claims the benefit of Belgian Application No. 2002/0575 filed Oct. 4, 2002.

BACKGROUND OF THE INVENTION

The invention relates to a method for manufacturing components consisting of one piece which appear in a weaving machine, comprising one or more first and second parts, said parts being manufactured in separate first and second parts and being joined to form one piece by means of processes which practically do not change the cross-section of said parts.

Up to the present, in weaving machines, one has to deal with manufacturing long components having a small cross-section, the manufacturing process selected being determined by the requirements which may be imposed on a local part of the components, but where the method of manufacturing is applied to the entire component. By long components are meant components having a total length situated between about 0.4 and 2 meters, the local parts determining the method of manufacturing for the total component being shorter than 0.3 meters.

Moreover, specific tribological, mechanical and/or magnetic properties are required for these local parts. By tribological properties are meant, for instance, being free of burrs, pure, polished, etc. Furthermore, these local parts may be subjected to certain specific requirements as to their shape, for instance having recesses, deflections, local broadenings and others and/or combinations of these features.

The disadvantage is, that most of the time, the method for manufacturing these local parts is expensive and/or labor-intensive. Because the method of production required has to be applied for the entire part, and the tribological, mechanical and/or magnetic properties required are possibly required for the parts which are not essential for the method of production, the costs for production of such long parts are very strongly increased, and obviously additional costs and labor are required.

More particularly, the invention relates to, for instance, heddles, lancets, hooks, etc., where the properties, method of production and/or other provisions required for a local part of these components are essential for the entire component, because of which manufacturing such components is an expensive matter.

In JP 60119245 a method is described, for instance, for manufacturing a heddle, which is used in a weaving machine, comprising a narrow centerpiece, which has an opening through which a yarn may be passed, and both extremities of which have an indentation or a hole to be connected to a heddle rod. The narrow centerpiece being made independently of the rest from sheet metal and attached to it. The sheet metal may consist of rolled leaves having rounded sides. Holes and/or indentations have been punched in them and then they are welded by means of a laser or electron beam. Such a method solves the problem that one stage of the process, for instance, a polishing or grinding process, to give the heddle its final shape, may be reduced or eliminated.

The drawback of such a heddle is that the center piece and the outer parts are made of the same material, whereas the center and outer parts have different functions, and the material used for the center part is less optimal for the outer parts and inversely, or that a material is selected which will be a compromise between the requirements for both parts.

In BE 571 667 a harness loop is described for weaving machines, more particularly at the extremity of hooks for a harness free of riders. In addition to openings for the guide rails and for the warp yarns, these harness loops have at least one discontinuity or opening at each extremity in the direction of the plane formed by the harness loops lined up, by means of which they are laced up to an independent lining up instrument. Thus, for instance, the harness loop at its extremity has a hook, which is hung onto a U-shaped channel corresponding to a guide rail, which is attached, for instance, to a supporting rod of the weaving machine or is part of it. The hook is connected to the spindle of the harness loop by means of a welding or brazing process.

A disadvantage of such a harness loop is that the parts connected to one another are each machined at their extremity to such a form that both parts are fitting together in a manner that they may be removed from one another in the longitudinal direction. This fit is secured by a weld. Machining these parts is time-consuming and expensive and the welded part has bulges caused by the weld.

SUMMARY OF THE INVENTION

The purpose of the invention is to provide a method for manufacturing components consisting of one piece and appearing in a weaving machine, not having the drawbacks mentioned above. An additional purpose of the invention is to provide a method according to the invention, where the components may be produced in the cheapest possible manner and yet will have the best possible mechanical properties.

This purpose is attained by providing a method for manufacturing components forming a whole, appearing in a weaving machine, comprising one or more first and second parts, said parts being manufactured in separate first and second parts and being united into a whole by means of processes which practically do not alter the cross-sections of said parts, but said first and second parts having:

- different mechanical and/or magnetic and/or tribological properties; and/or
- a different manufacturing method; and/or
- different shape properties according to their functional requirements in the component.

Providing such a method has the advantage that the components are made up of material being most suitable, and therefore, per part or function optimally comply with the necessary requirements as to weight and/or other properties.

Moreover, the parts requiring a more expensive and/or a more labor-intensive manufacturing method may be carried out cheaper because of the smaller dimensions.

In a preferred method according to the invention, finishing the parts requiring the most expensive and/or the most labor-intensive production method is done by means of a vibrating drum.

Using such a finishing technique is cheaper and may possibly be automated.

In a preferred method according to the invention, said first and second parts are connected to one another by means of resistance welding and/or laser beam welding.

The advantage of these techniques is that they may be carried out such, that no, or only at the transition, limited finishing is required. The various parts of the components where they are joined together may have the same or different shapes and dimensions, and the various parts of the component may be of the same or of different materials.

In a more specific method according to the invention, the parts requiring the most expensive and/or the most labor-intensive manufacturing method have a length which is shorter than 0.3 meters and the entire component has a length situated between about 0.4 and 2 meters.

In a preferred method according to the invention, finishing the parts requiring the most expensive and/or most labor-intensive manufacturing method, is done by means of a vibrating drum.

More specifically, the method is applied to components appearing in a weaving machine or jacquard weaving machine.

A first example of such a component is a hook, comprising:

- a first part consisting of a piece stamped from a material, which may be covered by overmoulding;
- a second part consisting of a flat piece of material having adequate magnetic properties;
- a third part consisting of a piece stamped from spring steel;
- a fourth part consisting of a flat piece of material available on the market; and
- a fifth part consisting of a stamped piece of material.

A second example of such a component is a lancet, comprising:

- a first part consisting of a stamped piece of material having an adequate shape;
- a second part, consisting of a strip having a cross-section corresponding to the shape of flat steel; and
- a third part consisting of a stamped piece of material designed to be placed into the lancet holder.

A third example of such a component is a heddle, comprising:

- a first part made of wire material;
- a second part consisting of a stamped piece of material; and
- a third part made of wire material.

Preferably, said second part, at one or both sides, ends in a cylindrical extremity having the same diameter as the wire material of the first and/or of the third part.

In order to further clarify the properties of the resent invention and to point out its additional advantages and particulars, a more detailed description of some components of a Jacquard machine, manufactured according to a method according to the invention will follow hereafter.

It may be obvious that nothing in the following description may be interpreted as being a restriction of the protection demanded for in the claims for the method according to the invention.

In this description, by means of reference numbers, reference is made to the attached drawings of which:

DETAILED DESCRIPTION OF THE PREFERRED EMBODIMENTS

Figure 1:
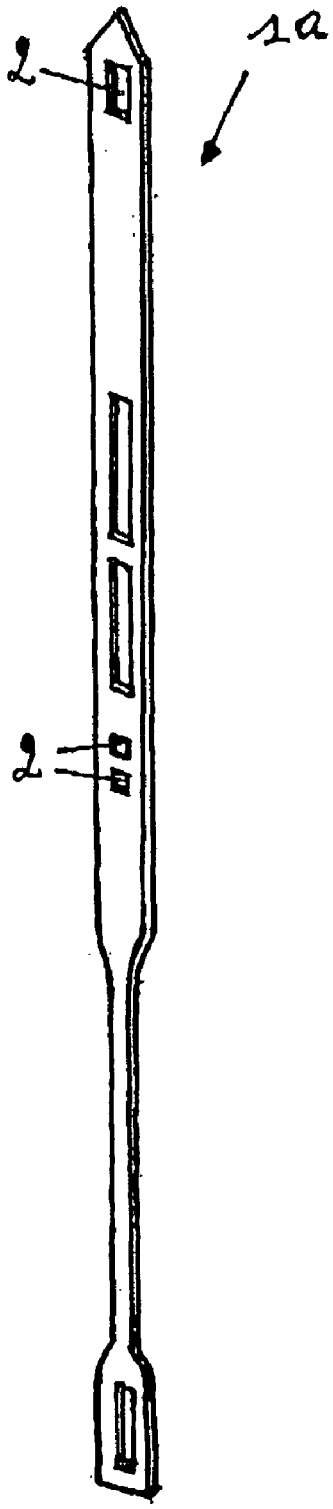
FIG. 1 is representing a hook made in one piece, as known in the state of the art.

In a method according to the invention for manufacturing components consisting of one piece, appearing in weaving machines and comprising one or more different first parts, these parts are manufactured as separate parts and joined into a whole by means of processes which practically will not change the cross-sections of said parts. For each of the different parts of the component the most suitable design is produced or obtained according to the existing methods or channels in a condition, which will meet the necessary requirements.

The processes which practically do not change the cross-section of said parts are, for instance, resistance welding (=friction welding) or laser beam welding. By applying these processes, no finishing is required or only a limited finishing operation is required in the transition zone.

The different parts may have:

- different mechanical and/or magnetic and/or tribological properties; and/or
- different manufacturing methods; and/or
- different properties as to their shape.

By tribological properties is meant, for instance, being free of burrs, pure, polished, etc. Furthermore, these local parts may have specific requirements as to their shape, such as, for instance, recesses, deflections, local broadenings and others and/or combinations of these features.

More specifically, this method is applied when manufacturing long components. By long components, components are meant of about 0.4 to 2 meters long, where the local parts have a length being shorter than 0.3 meters.

These long components have

- specific mechanical and/or magnetic and/or tribological properties and/or:
- specific requirements as to their shape; and/or
- a specific manufacturing method.

These requirements are more expensive compared to the other parts of the components which may be either manufactured in a very economic way of may be bought on the market having the necessary requirements, such as, among others, the tribological properties.

Therefore, the local parts are manufactured separately and provided with the necessary requirements, and then joined together by means of one of the processes mentioned above.

Some examples of such long components of weaving machines are:

Lancets:

In the Jacquard weaving process, lancets are used, or instance, to determine the height of the loops or to keep the upper and lower fabrics separated from one another in face-to-face weaving. These parts have to be fixed in a lancet holder, and they may be carried out in a stepped shape in order to be able to realize a variable intermediate height or they may be deflected in order to enable a adequate forming of the shed in, for instance, triple rapier weaving.

In consequence of these requirements, it is appropriate to use a manufacturing method such as stamping, which, according to the state of the art, should be used over the full length and after which the component has to be finished over its entire length.

When a method according to the invention is applied than the lancet is composed of:

- a first part, consisting of a stamped piece of material having an adequate shape, for instance, a stepped shape;
- a second part consisting of a strip having a cross-section corresponding to that of flat steel; and
- a third part, consisting of a stamped piece of material, designed to be fixed in the lancet holder.

Figure 2:
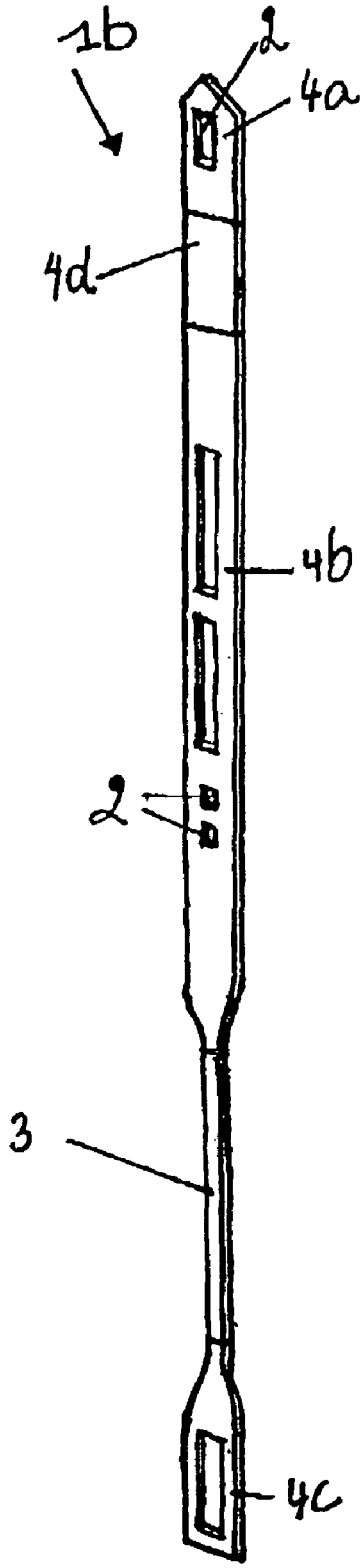
FIG. 2 is representing a hook made of 5 parts according to the invention.

Hooks:

A hook (1*a*, 1*b*) as represented in the FIGS. 1 and 2, is used in the Jacquard part of a Jacquard weaving machine by coupling it or not to the blades moving up and down in order to bring the coupled, pattern forming pile warp yarns in their exact position in the shed. Therefore the hooks (1*a*, 1*b*) are provided with recesses (2) in order to overmould the hook with synthetic material hooking onto the blades or to overmould the nose hooking onto the selector housing, by means of extrusion. For this purpose, the hook (1*a*) according to the state of the art, as shown in FIG. 1 is stamped, over its entire length, from spring steel, which is chosen as a compromise in order to comply with the various functional requirements of the hook (1*a*). The entire hook (1*a*) is made, for instance, of spring steel having lower magnetic properties, but higher elastic properties, thus allowing the hook (1*a*) to be drawn against the selector housing.

In a hook (1*b*) according to the invention, as shown in FIG. 2, the non-functional part (3) is made of flat steel, available on the market, which is sufficiently pure. The functional parts (4*a*, 4*b*, 4*c*, 4*d*) are made according to the most suitable design.

So, the component is composed of:

- a first part (4*a*) consisting of a stamped piece of material, which may be covered by overmoulding;
- a second part (4*d*) consisting of a flat piece of material having adequate magnetic properties, so that it may be influenced by a magnetic selector;
- a third part (4*b*) consisting of a stamped piece of spring steel;
- a fourth part (3) consisting of a flat piece of material available on the market; and
- a fifth part (4*c*) consisting of a stamped piece of material.

Figure 3:
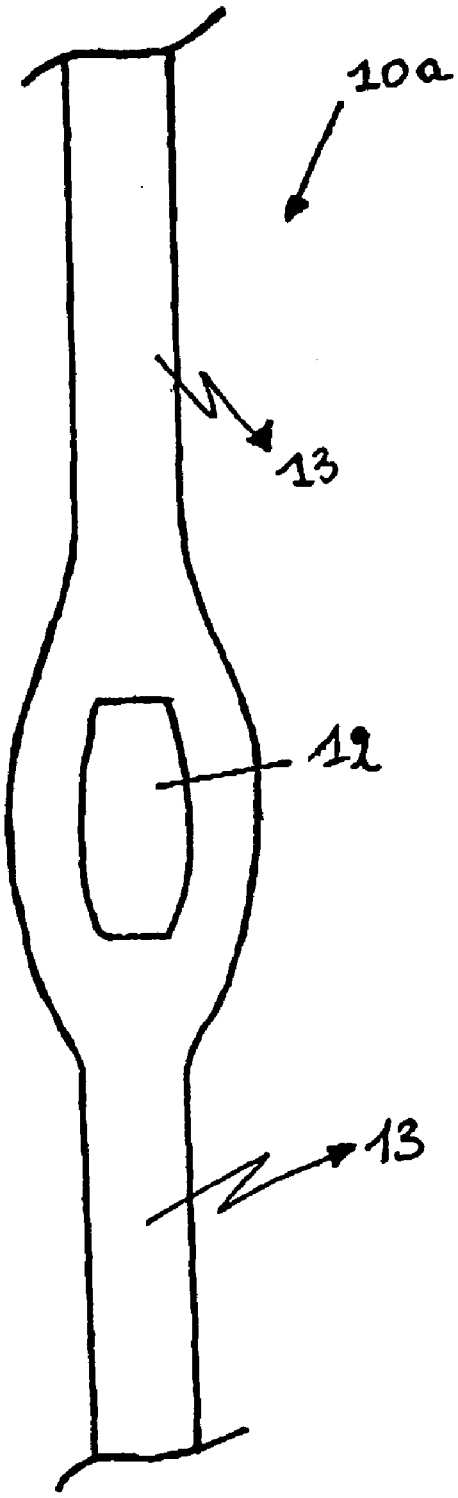
FIG. 3 is representing a heddle of flat steel made in one piece, as known in the state of the art.
Figure 4:
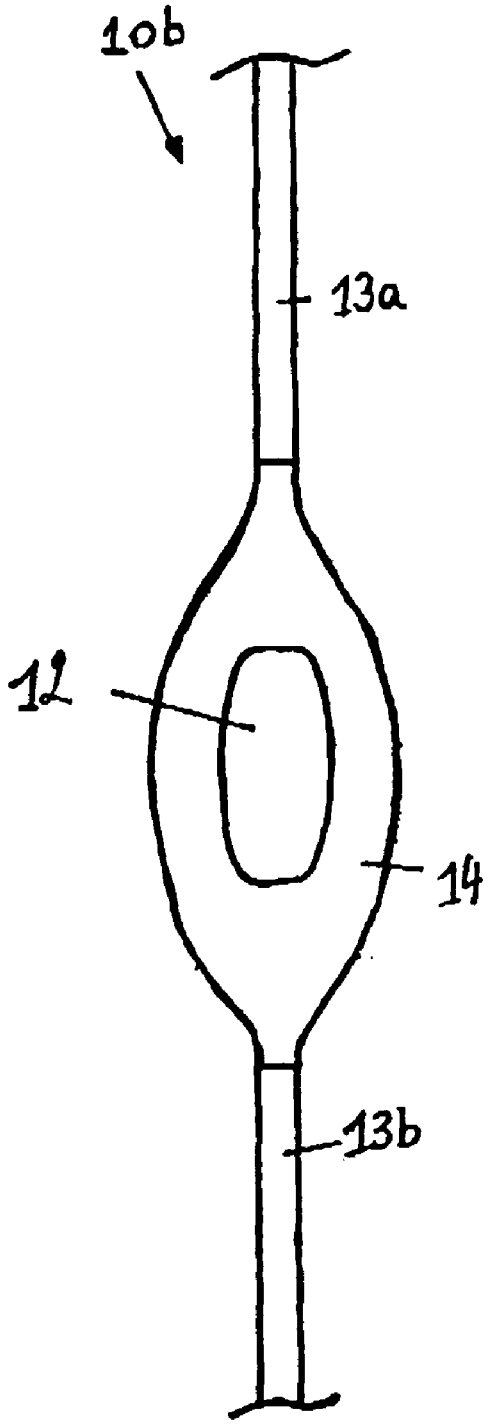
FIG. 4 is representing a heddle composed of three parts according to the invention.

Heddles:

A heddle (10*a*, 10*b*), as partly represented in the FIGS. 3 and 4, comprises a guide eye (12) which has to guide one or more warp yarns to bring them into the position required with respect to the shed.

A flat steel heddle (10*a*) according to the state of the art, as shown in FIG. 4 is made in one piece. The requirements demanded from the guide eye (2) require a manufacturing method such as stamping which, according to the state of the art, should be used over its entire length. Then an expensive operation to finish the part will be necessary.

When the guide eye (12) is left out of account, the function of the remaining parts (13) of the heddle (10*a*) shown, may be entirely taken over by a wire or even by flat steel, both available on the market.

The second part (4) in which the eye of the heddle is provided, should rather be made of a wear-resistant material, because it should be capable of resisting the wear and tear caused by the warp yarns which are guided through it, whereas the heddle wire parts (3*a*, 3*b*) should be made of a material having rather flexible properties, because they must be able to react to the tensions in the warp yarn in the warp direction.

As shown in FIG. 4, the heddle (10*b*) according to the invention is composed of:

- a first part (3*a*) made of wire material (or flat steel);
- a second part (4) consisting of a stamped piece of material; and
- a third part (3*b*) made of wire material.

Preferably, one end or both ends of the stamped part or the second part (4) ends in a shape having a cross-section corresponding to the cross-section of the first (3*a*) and/or the third part (3*b*) (for instance, wire or flat steel).

Therefore this invention may be applied to long components as well, which are used in weaving machines.

The invention claimed is:

1. Method for manufacturing components made in one piece, which appear in a weaving machine, comprising one or more first and second parts, said parts being manufactured in separate first and second parts and being joined together to form a whole by means of processes which practically do not change the cross-section of said parts, wherein said first and second parts have:

- different mechanical and/or magnetic and/or tribological properties; and/or
- a different manufacturing method; and/or
- different shape properties according to their functional requirements in the component, wherein said component is a hook (1*b*), comprising:
- a first part (4*a*) consisting of a stamped piece of material, which may be covered by injection moulding;
- a second part (4*d*) jointed to the first part and consisting of a flat piece of material having adequate magnetic properties, so that it may be influenced by a magnetic selector;
- a third part (4*b*) jointed to the second part and consisting of a stamped piece of spring steel;
- a fourth part (3) jointed to the third part and consisting of a flat piece of material; and
- a fifth part (4*c*) joined to the fourth part and consisting of a stamped piece of material.

2. Method for manufacturing components made in one piece, which appear in a weaving machine, comprising one or more first and second parts, said parts being manufactured in separate first and second parts and being joined do not change the cross-section of said parts, wherein said first and second parts have:

- different mechanical and/or magnetic and/or tribological properties; and/or
- a different manufacturing method; and/or
- different shape properties according to their functional requirements in the component, wherein said component is a lancet, comprising:
- a first part, consisting of a stamped piece of material having an appropriate shape;
- a second part consisting of a strip having a cross-section corresponding to that of flat steel; and
- a third part, consisting of a stamped piece of material, designed to be fixed in a lancet holder.

3. Method for manufacturing components made in one piece, which appear in a weaving machine, comprising one or more first and second parts, said parts being manufactured in separate first and second parts and being joined together to form a whole by means of processes which practically do not change the cross-section of said parts, wherein said first and second parts have:

different mechanical and/or magnetic and/or tribological properties; and/or a different manufacturing method; and/or different shape properties according to their functional requirements in the component, wherein said component is a heddle (10*b*), comprising:

a first part (13*a*) made of wire material or flat steel;

a second part (14) consisting of a stamped piece of material; and a third part (13*b*) made of wire material.

4. Method according to claim 3, wherein said second part at one of its two sides ends in a cylindrical extremity having the same diameter as the wire material of the first (13*a*) and/or the third part (13*b*).

* * * * *